United States Patent [19]

Wight

[11] 4,217,846

[45] Aug. 19, 1980

[54] BOAT BAILING APPARATUS

[76] Inventor: Gary E. Wight, 7535 Tanager, Houston, Tex. 77039

[21] Appl. No.: 925,450

[22] Filed: Jul. 17, 1978

[51] Int. Cl.[2] ..... B63B 13/00; B63B 29/16

[52] U.S. Cl. ..... 114/185; 114/197; 137/533.11

[58] Field of Search ..... 137/533.11, 533.13; 114/183 R, 183 A, 184, 185, 197, 198

[56] References Cited

U.S. PATENT DOCUMENTS

| | | | |
|---|---|---|---|
| 933,891 | 9/1909 | Curry | 114/185 |
| 1,241,408 | 9/1917 | Lizarraga | 114/185 |
| 2,476,434 | 7/1949 | Spang | 137/533.11 |
| 2,772,648 | 12/1956 | De Persia | 114/185 |
| 3,029,768 | 4/1962 | Spurlock | 114/185 |
| 3,044,433 | 7/1962 | Guta | 114/197 |
| 3,565,031 | 2/1971 | De Persia | 114/185 |

FOREIGN PATENT DOCUMENTS

| | | | |
|---|---|---|---|
| 1185070 | 3/1970 | United Kingdom | 114/183 R |

*Primary Examiner*—Trygve M. Blix
*Assistant Examiner*—D. W. Keen
*Attorney, Agent, or Firm*—Bill B. Berryhill

[57] ABSTRACT

Boat bailing apparatus for removing water from the interior of a boat comprising: a tubular housing adapted for attachment to the transom of the boat providing a passage through which fluid may pass from the interior of the boat to the exterior thereof; an annular seat near one end of the housing; and a ball closure carried within the housing for movement between a position engaging the seat, preventing fluid flow through the passage, and positions not engaging the seat, permitting fluid flow. A cage assembly may be provided within the housing to confine the ball closure for limited axial movement in the housing passage.

6 Claims, 3 Drawing Figures

BOAT BAILING APPARATUS

BACKGROUND OF THE INVENTION

1. Field of the Invention

The present invention pertains to apparatus for removing water which may accumulate in a boat. Specifically it pertains to boat bailing or draining apparatus which permits flow of water out of a boat, but prevents backflow into the boat from the exterior thereof.

2. Brief Description of the Prior Art

It is well known that boat hulls accumulate water from spray and wave action as well as from precipitation. The accumulated water may soak the contents of the boat, including its passengers and too much accumulation can result in danger of sinking.

Accumulated water can be removed by buckets, but one is not always available. Furthermore, it is difficult to totally remove the water with a bucket. Of course, the boat can be turned over to remove the water therefrom. Some boats are provided with drain plugs in the bottom of the boat or its transom to allow water to be drained therefrom. In the last two mentioned methods, it is necessary to remove the boat from the water. This is not always easy to do and in fact may be impossible at times when it is vitally necessary to empty the boat of its accumulated water.

In recent years, several boat bailing devices have been developed to overcome the problems associated with the crude methods previously described. Most of these devices attempt to provide some sort of one-way valve apparatus which allows water to flow out of the boat but prevents its reentry thereinto. Some of these devices utilize a flapper-type valve. Examples may be seen in U.S. Pat. Nos. 2,959,144 and 3,011,468. Others utilize some sort of ball valve apparatus. Examples of this type may be seen in U.S. Pat. Nos. 2,772,658 and 3,394,671. U.S. Pat. No. 3,029,768 discloses a sleeve or plunger type bailing device and U.S. Pat. No. 3,060,882 discloses a collapsible bladder type valve device.

While recently developed boat bailers are definite improvements over the prior art, they are not totally satisfactory, having one or more faults or characteristics not suitable for all applications. While these devices operate well under certain conditions, they may have a tendency to leak under other conditions. Some of their designs require that the exit therefor be above the boat waterline, so that the boat is never totally emptied or water. Others require installation in the bottom of the boat, weakening its hull and rendering the device more susceptible to damage and malfunction from underwater obstacles. Others are complex, susceptible to malfunction and not easy to repair. Accordingly, the search continues for better boat bailing devices.

SUMMARY OF THE PRESENT INVENTION

The present invention provides a boat bailing device of the ball-type which is superior to boat bailing devices of the prior art. The device includes a tubular housing which is adapted for attachment to the transom of a boat providing a passage through which fluid may exit from the interior of the boat to the exterior thereof. An annular seat is centrally disposed near one end of the housing and provides an opening through which the fluid may exit from the boat. A ball closure is carried within a cage device in the housing for limited axial movement between a position engaging the seat, preventing backflow through the device, and positions not engaging the seat, permitting exit of the fluid from the boat. The cage device confines the ball closure for limited axial movement between a position engaging the seat, preventing backflow through the device, and positions not engaging the seat, permitting exit of the fluid from the boat. The cage device confines the ball closure for limited axial movement and assures that it will function properly in preventing backflow through the device. A manual shut-off valve may be provided for periods of non-use or maintenance.

The boat bailing apparatus of the present invention is very effective in removing accumulated water in the hull of a boat. It does not require installation above the waterline of the boat and is less susceptible to leakage than other boat bailing devices. It is easily installed in the plug hole normally in the transom of a boat where it is less likely to weaken the boat's structure and where it is less susceptible to damage from underwater hazards. The operating mechanisms thereof are simple, trouble-free and less likely to malfunction than some of the complex devices of the prior art. Other objects and advantages of the present invention will be apparent from the description which follows in conjunction with the accompanying drawings.

DESCRIPTION OF THE PREFERRED EMBODIMENT

Figure 1:
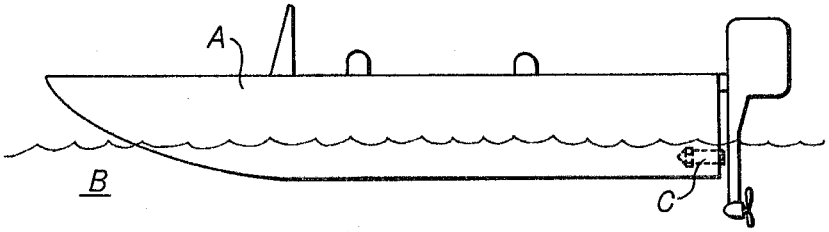
FIG. 1 is a pictorial illustration of a boat, utilizing boat bailing apparatus according to a preferred embodiment of the invention, in which the boat is at rest in a body of water.

Referring first to FIG. 1, there is illustrated a boat A at rest in a body of water B. Installed in the transom of the boat is a boat bailing device C. It will be noted that with the boat at rest as in FIG. 1, the boat bailing device C is below the waterline of the boat. If the boat is in motion as in FIG. 2, the boat bailing device C may be above the surface of the water body B.

Figure 3:
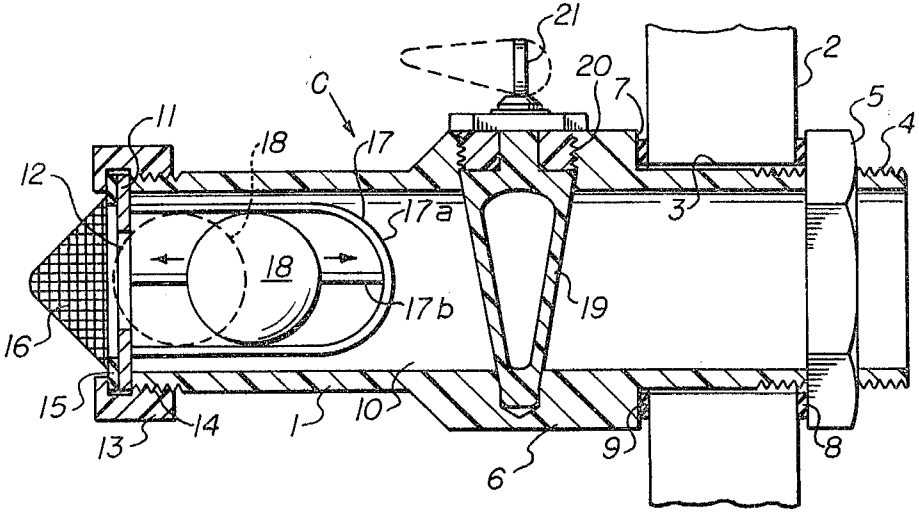
FIG. 3 is a longitudinal section view of the boat bailing apparatus according to a preferred embodiment of the invention.

Referring now to FIG. 3, the boat bailing device C includes a tubular housing 1 adapted for attachment to the transom 2 of a boat. A hole 3 (normally present in most boats) is preferably provided through the transom through which a first threaded end 4 of the housing may be inserted for engagement by a nut 5. The housing may be enlarged at 6 to provide a shoulder 7. Thus, the nut 5 and shoulder 7 serve to rigidly attach the device to the transom 2. Annular seals 8 and 9 prevent leakage at this connection.

The housing 1 provides a generally cylindrical passage 10 through which fluid may pass from the interior of the boat in which the device is installed to the exterior thereof. At the forward end of the housing 1 is an annular seat member 11 which provides a central opening 12 through which fluid may flow from the boat interior into the passage 10. The seat member 11 may be attached to the housing 1 by a retainer ring 13 which threadedly engages threads provided on the internal second threaded end 14 of housing 1. An annular seal 15 may be provided between the ring 13 and seat member 11 to assure a fluid-tight joint. Attached either to the seal ring 15 or the retainer ring 13 is a screen 16 for preventing the passage of solids above a predetermined size through the bailing apparatus.

Carried within a cage member 17 for limited axial movement within passage 10 is a ball closure member 18. When the ball closure member is in the position indicated by dotted lines, it engages the seat member 11 preventing fluid flow through the opening 12. When the ball member 18 is in any other position not engaging the seat member 11, fluid flow is permitted through the opening 12 into the passage 10 for exit from the boat. The cage member 17 can be formed in any suitable manner. As illustrated, it is formed by a pair of U-shaped members 17*a* and 17*b*, the ends of which are attached to the seat member 11. In whatever manner it is constructed, the cage member 17 is designed so as to confine the ball member 18 in the center of the passage 10, leaving an annular space between the ball member 18 and the interior walls of housing 1.

Although it is not necessary, a hand-operated shut off valve may be provided between the ends of the apparatus. The enlarged portion 6 of the housing forms the body of the valve which may include a frusto-conical closure member or plug 19. The closure member 19 may be inserted through a hole in the enlarged part of the housing 6 and held in place by a threaded retainer ring 20. A handle 21 may be attached to the closure member or plug 19 for manipulation thereof. Under normal circumstances, the valve will be open. However, for prolonged periods of non-use, the valve may be closed.

STATEMENT OF OPERATION

Referring now to all of the drawings, operation of the boat bailing apparatus C of the present invention will be described. As earlier mentioned, the closure member 19 will be opened so that the passage 10 is free to allow flow of fluids therethrough. When the boat A is at rest in the water as in FIG. 1, the bailing apparatus C is below the waterline. Therefore, water from the body of water B will enter the passage 10 from the exterior of the boat. Pressure from the water and the buoyancy of ball 18 forces the ball to the dotted line position engaging seat 11, blocking reverse flow through the apparatus and preventing any water from entering the boat through passage 10.

Figure 2:
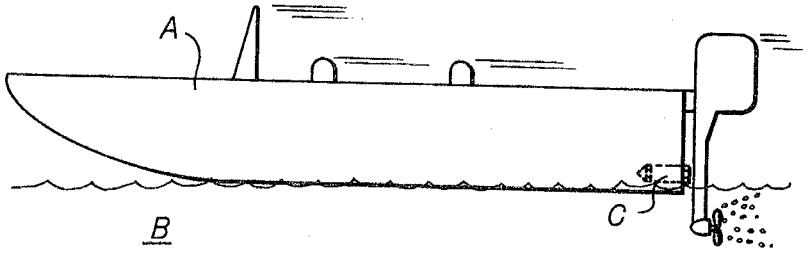
FIG. 2 is a pictorial illustration of a boat utilizing the boat bailing apparatus of the present invention, showing the boat in motion.

After the boat is in motion, the bailing apparatus C may be above the surface of the water body B as shown in FIG. 2. Furthermore, due to the motion of the boat and the forces of gravity, the ball member 18 moves to a position represented by the solid line position thereof, not engaging the seat 11, unblocking the opening 12 and allowing any water which may accumulate in the boat to enter passage 10 for emptying into the water body B.

As already mentioned, for long periods of nonuse or for maintenance of the boat bailing apparatus, it may be desirable to close the plug 19, blocking both directions of flow through the passage 10. With the plug 19 closed, the seat 11, ball member 18 or other components may be removed for replacement or repair. It will be noted that nearly all components of the bailing device C are located on the interior side of the boat transom 2.

As can be seen, the boat bailing apparatus C of the present invention is extremely simple yet efficient. It eliminates problems associated with boat bailing devices of the prior art. While a single preferred embodiment of the invention has been described herein, many variations can be made without departing from the spirit of the invention. Accordingly, it is intended that the scope of the invention be limited only by the claims which follow.

I claim:

1. Boat bailing apparatus for removing fluid from the interior of a boat comprising:

a tubular housing adapted for attachment to the transom of a boat providing a substantially horizontal passage through which fluid may pass from the interior of said boat to the exterior thereof;

annular seat means centrally disposed near one end of said housing providing an opening through which said fluid may flow from said boat interior and into said passage for exit to said boat exterior;

ball closure means carried within said housing for limited axial movement within said passage between a position engaging said seat means, preventing said fluid flow through said opening, and positions not engaging said seat means, permitting said fluid flow;

cage means carried within said housing and in which said ball closure means is disposed for said limited axial movement, said cage means confining said ball closure means to the center of said passage so as to leave a surrounding space between said ball closure means and said housing at all times; and a valve member carried by said housing downstream of said cage means and manually operable from the interior of said boat to close said passage regardless of the position of said ball closure means.

2. Boat bailing apparatus as set forth in claim 1 including seat retainer means removably attached at said one end of said housing, removal of which allows removal of said seat means and said ball means from said one end of said housing without disturbing the rest of said apparatus.

3. Boat bailing apparatus as set forth in claim 2 in which the end of said housing opposite said one end is provided with an external annular shoulder for abutment against the interior side of a boat transom through which a hole is provided to sealingly receive a portion of said opposite end of said housing, said opposite end of said housing also being provided with threads for threaded engagement with a nut member on the exterior side of said transom for providing said attachment of said housing to said boat transom.

4. Boat bailing apparatus as set forth in claim 1 in which said cage means is adapted for substantially horizontal installation within said housing said ball closure means being responsive to movement of said boat in a forward direction for disengagement from said seat means to permit fluid flow from the interior of said boat to the exterior thereof.

5. Boat bailing apparatus as set forth in claim 4 in which said housing is adapted for installation below the waterline of said boat when at rest, said ball closure means being responsive to fluids on the exterior of said boat for engagement with said seat means to prevent passage of fluid from the exterior of said boat into its interior.

6. Boat bailing apparatus as set forth in claim 1 in which said housing is adapted for attachment to said boat so that said ball closure means, cage means and valve member are all located within the interior of said boat.

* * * * *